US005365750A

United States Patent [19]

Greenthal

[11] Patent Number: 5,365,750

[45] Date of Patent: Nov. 22, 1994

[54] REMOTE REFRIGERATIVE PROBE

[75] Inventor: Steven Greenthal, Newport Beach, Calif.

[73] Assignee: California Aquarium Supply, Cerritos, Calif.

[21] Appl. No.: 993,733

[22] Filed: Dec. 18, 1992

[51] Int. Cl.[5] ..... F25B 3/00

[52] U.S. Cl. ..... 62/293; 62/51.2; 165/142

[58] Field of Search ..... 62/293, 51.2; 165/142

[56] References Cited

U.S. PATENT DOCUMENTS

| | | | |
|---|---|---|---|
| 2,499,782 | 3/1950 | Sabaut | 165/142 |
| 2,566,865 | 9/1951 | Wingerter | 62/293 |
| 2,672,032 | 3/1954 | Towse | 62/126 |
| 2,679,732 | 6/1954 | Dolz | 62/115 |
| 2,726,658 | 12/1955 | Chessey | 62/293 |
| 3,228,400 | 1/1966 | Armao | 128/303.1 |
| 3,274,797 | 9/1966 | Kritzer | 62/511 |
| 3,469,415 | 9/1969 | Cornelius | 62/394 |
| 3,867,819 | 2/1975 | Hartman et al. | 62/293 |
| 3,910,278 | 10/1975 | Crandall et al. | 62/293 |
| 3,950,963 | 4/1976 | Sutherland | 62/268 |
| 4,206,609 | 6/1980 | Durenec | 62/6 |
| 4,825,667 | 5/1989 | Benedict et al. | 62/51.2 |
| 4,831,846 | 5/1989 | Sungaila | 62/51.3 |
| 5,078,713 | 1/1992 | Varney | 606/23 |
| 5,147,355 | 9/1992 | Friedman et al. | 606/23 |

FOREIGN PATENT DOCUMENTS

| | | | |
|---|---|---|---|
| 636478 | 5/1950 | United Kingdom | 165/142 |
| 1118843 | 10/1984 | U.S.S.R. | 165/142 |
| 1206599 | 1/1986 | U.S.S.R. | 165/142 |

*Primary Examiner*—Ronald C. Caposela
*Attorney, Agent, or Firm*—Fulwider Patton Lee & Utecht

[57] ABSTRACT

The refrigerative probe comprises in combination an insert member fit into, and cooperating with, a probe housing to provide an elongated flowpath in fluid communication with the inner surface of said probe housing. The elongated pathway, being partly defined by a channel formed in the outer surface of the insert member and partly formed by the probe housing, is easily formed in the assembled probe by inserting the insert member into the probe housing.

20 Claims, 3 Drawing Sheets

FIG. 1
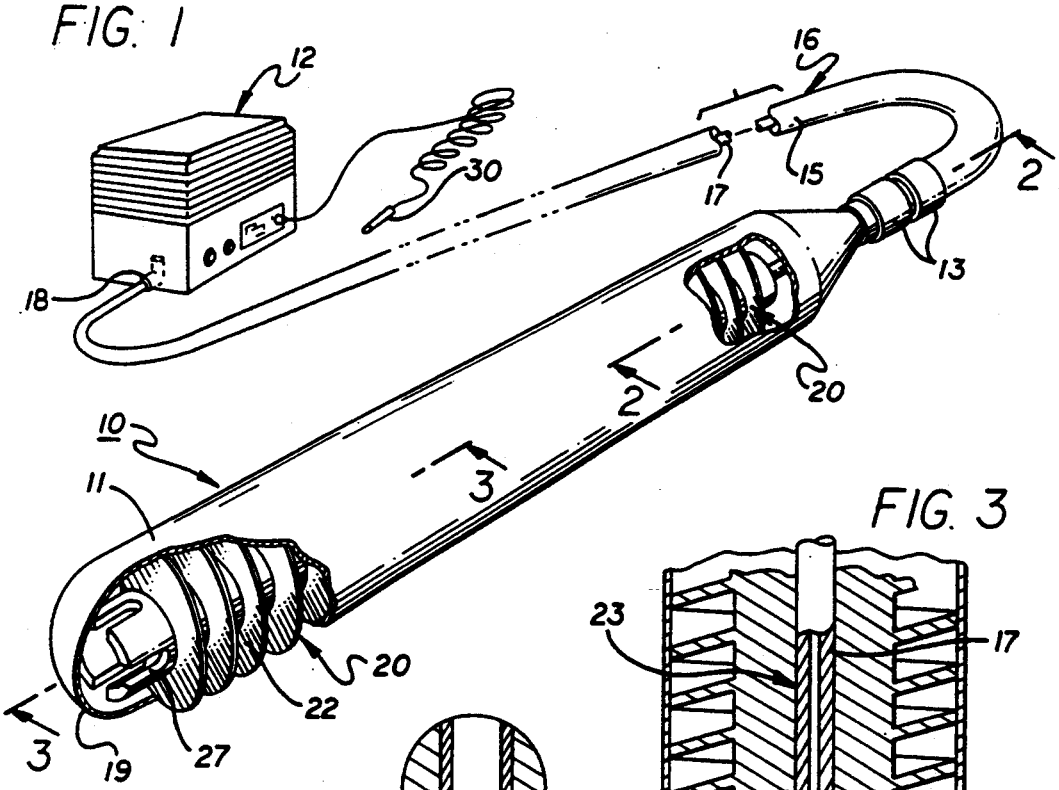
FIG. 3
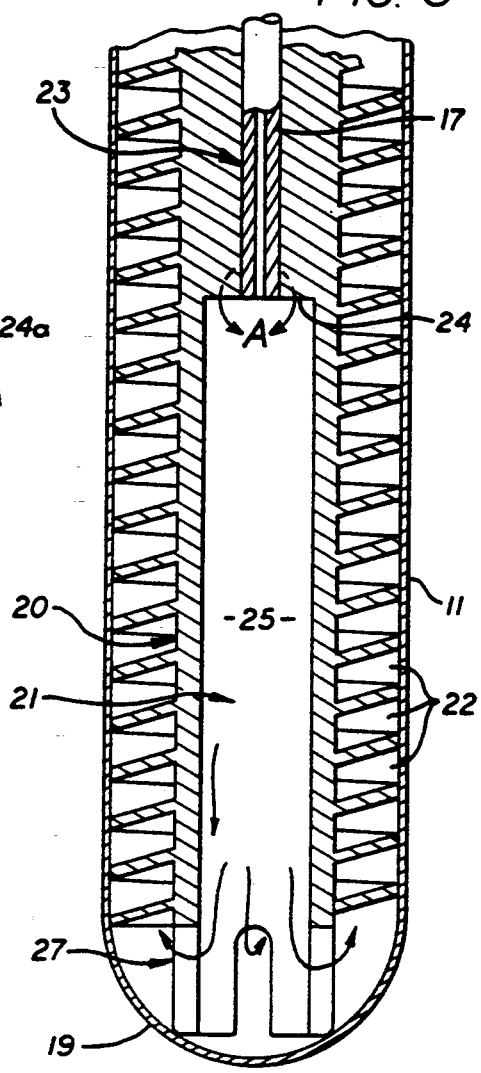
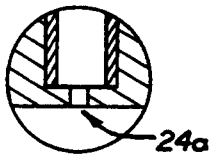
FIG. 3A
FIG. 2
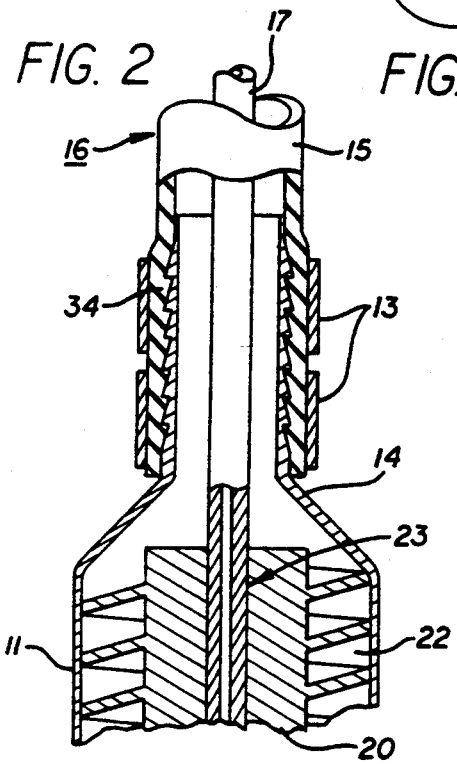

REMOTE REFRIGERATIVE PROBE

BACKGROUND OF THE INVENTION

1. Field of the Invention

This invention relates to refrigeration equipment for use in applications where a probe is placed within an environment to remove heat therefrom. More particularly, the invention relates to the configuration of a remote refrigeration probe. The invention concerns the structure of the probe and how a refrigerant is conducted through the probe to provide a refrigerative effect.

2. Description of Related Art

Refrigerative probes can be useful in certain applications, for example, harsh chemical environments, high humidity, wet, or liquid environments where it is convenient to often place the probe in and out of the environment, for example for cleaning. It has been found for example that such probes are very useful for controlling the temperature of aquariums where the desired temperature of the liquid environment within the aquarium is below the ambient temperature of the environment surrounding the aquarium.

Also, remote refrigerative probes are useful and convenient when portability or manipulation of a cooling probe may be useful or required. For example in a manufacturing environment, or chemical processes it may be advantageous to easily move a cooling probe from one place or environment to another. Also, for example, in certain medical applications, including surgery, manipulation of a cooling probe would be desirable.

Refrigerative probes are also useful in refrigeration applications where size constraints are important; particularly concerning diameter of a refrigerative device that is invasive. For example, in the past refrigerative probes have been used to more rapidly freeze the interior of animal carcasses, to better preserve meat. In another example, thermal stabilization of soil has been undertaken using remote refrigeration techniques. This application usually requires that heat be evacuated through bore holes, hence refrigeration probes can be particularly useful.

Prior art refrigerative probes have a number of drawbacks. First, certain prior art probes having a relatively small size or cross-section are of relatively inefficient design. In such probes a central refrigerant tube extends through the interior of an outer probe housing to nearly reach a distal end. Refrigerant transits the tube and doubles back through the probe in a luminal space between the inner tubing and the outer probe housing. That arrangement is simple and low cost, however, it is relatively inefficient for heat transfer, as the refrigerant is in contact with the probe for only a very short time. The refrigerant optimally should be in contact with the probe for a prolonged period of time to absorb heat and more efficiently conduct heat from the environment of the probe away through an umbilical.

The efficiency of prior art refrigerative probes has been increased by the provision of coiled probes or of coils within the probe, whereby refrigerant is made to dwell longer within the probe for increased heat transfer. Such devices still have a number of problems however. Probes which comprise a coiled tube, or have a tubing coil on the external surfaces thereof may be more susceptible to damage by dents or otherwise fragile, or difficult to clean. Further, they may be more prone to problems in corrosive environments due to this cleaning problem. If a coil is contained within a separate protective housing, heat transfer between the environment and the coil may be compromised to some extent as heat then must be conducted through the housing as well as the coil, as well as any medium contained within the probe as to the majority of the surface area of the coil which is not in contact with the housing.

Additionally, provision of more complex arrangements (including spiral tubing arrangements) may contribute to higher cost in manufacturing refrigerative probes, due to an increased difficulty of manufacture.

Prior refrigerative probes with complex configurations, including spiral tubing arrangements and other complex geometries for increasing the thermal transfer efficiency properties of the probe may be difficult to miniaturize. Therefore the size of such devices is limited to relatively larger configurations making them unsuitable for certain applications. Moreover, the more complex and/or efficient the refrigerative probe is, the more resources must be applied in its manufacture, increasing its cost.

Hence, those concerned with the development and use of remote refrigerative probes have long recognized the need for an improved probe which will enable low cost manufacture of the device and yet give the relatively higher efficiencies associated with more complex devices. It has also been recognized that it would be desirable to obtain these properties in a probe that is rugged and adapted for use in harsh conditions, or environments where cleanliness is at a premium. The present invention fulfills these needs.

SUMMARY OF THE INVENTION

Briefly, and in general terms, the present invention provides a new and improved refrigerative probe. A probe according to principles of the present invention comprises a relatively thin walled probe housing means for defining the exterior of said probe and an insert member contained within the probe housing means. The insert member has a channel formed in its outer surface for providing an elongated fluid flowpath adjacent and in fluid contact with said probe housing means when the insert member is inserted into said probe housing. Refrigerant is directed along the flowpath within the probe in the evaporative portion of a refrigerative cycle to absorb heat through said probe housing means from the environment of the probe. This configuration results in improved probe performance and a lower cost of manufacture. In spite of its internal geometrical complexity, the probe is easily assembled due to the simplicity of having only two non-moving parts, and can be easily miniaturized. The insert member also internally supports the probe housing in a uniform manner, thereby making the probe resistant to dents and other damage and thus more rugged.

The combination of the probe housing and the insert member can have any shape, and the insert member can be molded or machined or stamped for example, out of any material compatible with the working temperatures contemplated and the refrigerant and lubricants (if any) that may be used. It has been found that a cylindrical shape works well, with the elongated fluid pathway disposed in a spiral around the cylindrical insert member, alternative fluid pathway configurations, including serpentine and crenelated patterns may be used. The probe housing is made to conform to the shape of the insert member or vice-versa and likewise can be formed of any compatible material. High thermal conductivity is desirable but not required in the housing material due to the thin cross-section of the housing of a probe according to the principles of the present invention.

The insert member may embody a conduit for conveying refrigerant from a proximal end to a distal end, or vice versa, to allow refrigerant to transit an elongated fluid pathway formed by the insert member and the probe housing in one, thus making connection of refrigerant lines solely at a proximal end of the probe easier. The insert member may also embody an internal heat exchange means associated with this conduit for intercooling of the refrigerant when structure comprising a Joule-Thomson valve in the refrigerative system is placed at a distal end of this conduit.

The refrigerative probe according to the present invention can have an elongated fluid pathway of many different configurations, and can be miniaturized for an affordable device for varied applications using both cryogenics and standard refrigeration systems.

Other features and advantages of the invention will become apparent from the following detailed description, taken in conjunction with the accompanying drawings, which illustrate, by way of example, the features of the invention.

DESCRIPTION OF THE DRAWINGS

FIG. 1 illustrates schematically a preferred embodiment of a refrigerative probe system in accordance with principles of the present invention;

FIG. 2 is a sectional view of a proximal portion of the probe, taken along line 2—2 in FIG. 1;

FIGS. 3 and 3A are sectional views of the distal portion of a probe, taken along line 3—3 in FIG. 1;

DETAILED DESCRIPTION OF THE PREFERRED EMBODIMENTS

Figure 4:
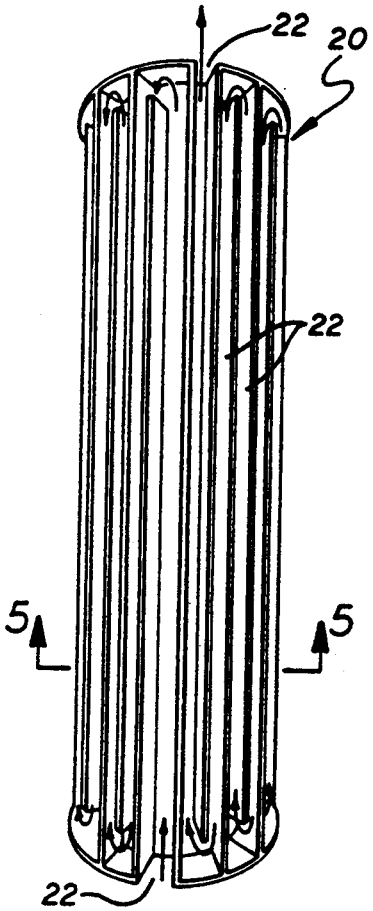
FIG. 4 is a perspective view of an alternate embodiment of an insert member that may be placed within the probe.

As shown in the drawings for purposes of illustration, the invention is embodied in a remote refrigerative probe 10 for cooling an environment or providing a localized area of reduced temperature. By way of example, the preferred embodiment of the probe illustrated and described herein is appropriate for cooling environments such as aquarium tanks, and certain other applications such as cooling of photographic processing baths. However, it will be appreciated that the device according to the present invention can be adapted to other applications, with changes of size, refrigerant, materials, and particular configurations, all of which may be dependent on the particular use.

Referring now to FIG. 1 the probe 10 is connected to a conventional condenser unit 12 by an umbilical 16. The umbilical is preferably coaxial in design, with a outer flexible tubular member 15 defining an annular luminal space **15*a* which conveys low pressure refrigerant on a return path from the probe to the condenser unit 12. An inner flexible tubular member 17 conveys high pressure refrigerant from the condenser unit to the probe in an inner lumen 17*a* within the inner tubular member. At the proximal end of the umbilical, and closely associated with or contained within the condenser unit 12** a bifurcation fitting (not shown) separates the outer low pressure lumen from the inner high pressure conveying tubular member.

A temperature sensor 30 may be provided, associated with the refrigerative probe system to control the operation of the condenser unit and refrigerative probe to provide controlled refrigeration of an environment or area adjacent to the probe. Conventional thermostatic control may be provided by use of the temperature sensor in any one of the number of conventional methodologies. When especially precise control of temperature is required, it has been found that use of a mercury switch thermostat as the temperature sensor 30 can provide particularly precise control of temperature adjacent the refrigerative probe or in the environment to be cooled. As an example, such mercury thermostats with preset or adjustable set points may be obtained from PSG Industries Inc. of Perkasie, Pa. It has been found that Model No. TM-801 from that manufacture works well in this application.

The temperature sensor, regardless of its type, may be fitted with a protective encapsulation coating, or a housing, so that it is suitable to the environment in which the probe will be used.

The condenser unit 12 may be of any suitable design, and employ a suitable refrigerant. The power size and optimal temperature ranges can be adjusted depending upon the application. It has been found that with the probe configuration herein described, by way of example, a conventional condenser unit model number CH250 manufactured by the Baytech company of Newport Beach, Calif., or model number AE3430A manufactured by the Tecumseh Products Company of Tecumseh, Mich. works well.

The probe 10 is about 1 inch (2.54 cm) in diameter and about 11 inches (28 cm) long. The umbilical outer member 15 has an inside diameter of about $\frac{3}{8}$ inches (1 cm). The umbilical inner member 17 has an outer diameter of about $\frac{1}{8}$ inches (0.3 cm), and an inside diameter of about 0.65 inches (1.7 cm).

The outer tubular member 15 of the umbilical is connected to a proximal connector portion 14 of the probe housing 11 and clamped thereto in a conventional manner by at least one clamp 13, and preferably two clamps. The inner tubular member 17 of the umbilical is connected to an insert member 20 within the probe 10 as will be described below.

Turning now to FIG. 2 in a preferred embodiment the refrigerative probe 10 in accordance with the present invention contains an insert member 20 which is pressed into the probe housing 11, and which cooperates with the probe housing to provide an elongated fluid pathway 22 in an annular area just below or inside of the probe housing 11 wherein refrigerant travels as it expands in returning to the low pressure side of the refrigerative system. The elongated flowpath 22 considerably increases the efficiency of the refrigerative probe 10.

The insert member 20, by way of example is a cylindrical element with a spiral grove in the outer surface extending from a distal end to a proximal end. This groove provides an annular elongated flowpath 22 for refrigerant when the insert member is inserted in the probe housing 11. As shown in FIGS. 2 and 3, the insert member also has a central lumen 21 extending from the proximal end to the distal end, having a proximal slip-fit lumen portion 23 and a distal expanded lumen portion 25, with a step transition 24 in lumen diameter at a point intermediate the proximal and distal ends. The central lumen conveys refrigerant from the high pressure inner umbilical tube 17 to a low pressure area of the refrigerative circuit associated with the distal end 19 of the probe 10.

The inner umbilical tube 15 is slip-fit into the proximal slip-fit lumen portion 23 of the insert member 20 which provides an easy way for connecting the two members. The slip-fit lumen portion 23 should be of sufficient length to prevent significant bleed-back of refrigerant between the outside of the inner umbilical tube member 17 and the inner surface of the slip-fit lumen portion 23 of the insert member 20 to its proximal end and the low pressure annular flowpath defined by the outer umbilical tube 15.

The slip fit is accomplished by boring the slip-fit lumen portion 23 to match the outside diameter of the inner umbilical tube 17, and then reaming the lumen to one thousandths (0.001") oversize, as is well known in providing a slip-fit. The umbilical tube is pre-straightened in a conventional manner and then slipped into the slip-fit lumen portion 23; the distal end of the inner umbilical tube coming to rest in approximately the same area as the step transition 24 in the central lumen 21. It has been found that extending the inner umbilical tube member 17 approximately six inches into the slip-fit lumen portion of the insert member 20 is sufficient to prevent significant bleed-back at working pressures associated with standard refrigerants, such as R-12 and R-22 for example. Thus, a slip-fit portion 23 this long will provide in effect a fluid-tight seal between the inner umbilical tube 17 and the insert number 20.

Alternatively, it may be desirable to otherwise provide a fluid-tight seal between the inner umbilical tube 17 and the insert member 20. This may be done by providing a sealant between the inner umbilical tube 17 and the insert member 20. An adhesive may be used, which may also allow the slip-fit lumen portion to be shortened, or eliminated. Alternately, the connection may be made by a threaded connection or by welding, braising, or most any other conventional connection means, depending upon the materials used for the inner umbilical tube and insert member.

As mentioned, at the distal end of the slip-fit lumen portion 23 a step transition 24 is provided in the central lumen 21 to the distal expanded lumen portion 25. The inner diameter of the expanded lumen portion is about $\frac{3}{8}$ inches. This expanded lumen portion constitutes the beginning of an evaporator portion of the refrigerative system, and the expanded diameter allows a refrigerant pressure drop from that of the refrigerant passing through the inner umbilical tube as is well known in the art. As illustrated in FIG. 3A in an alternate embodiment an orifice **24*a* comprising a Joule-Thomson valve in the refrigerative system, as is well known in the art, may be placed at the location of the step transition 24. This may be done for example by boring the central lumen from each of the proximal and distal ends of the insert number 20, and having the depths of the bores for the slip fit lumen portion 23 and the expanded lumen portion 25 to dimensions such that they do not meet, and afterward boring a small hole comprising an orifice to connect the respective lumen patterns. However, in this example the capillary tube comprising the inner umbilical tube 17** itself acts as a Joule-Thomson valve, and a more simple construction is effected by eliminating the separate provision of an orifice. It has been found that when a probe is constructed using elements of the sizes and model manufactured herein given, the device works well for umbilical lengths up to about 15 feet.

In certain relatively lower temperature applications it may be desirable to cool the refrigerant before it is allowed to expand. This may be done in a device in accordance with the present invention by providing an alternate embodiment wherein the refrigerant is made to linger within the insert member 20 for intercooling before being allowed to expand. This may be done for example by providing a relatively larger diameter central lumen 21 through a relatively longer portion of the insert member 20 and an orifice (not shown) near the distal a distal end portion 27 of the insert member. The orifice may be for example contained within an occluding element threaded into the distal end portion 27 or otherwise fixed to rest just proximal of said end portion 27. The inner surface of such a larger central lumen 21 may be provided with fins (not shown) to improve heat transfer. Alternately an elongated fluid pathway may be provided, for example by coiling the inner umbilical tubing within an expanded portion 25 of the central lumen 21, but this configuration is less desirable as it may shorten the length of the umbilical that may be used (holding all other parameters, for example condenser horsepower, constant).

In the exemplary embodiment illustrated by FIGS. 1, 2 and 3, the refrigerant expands and changes from a liquid to gaseous state as it exits the inner umbilical tube 17, transits the expanded lumen portion 25 to the distal end portion 27 of the insert member 20, reverses direction, and transits the annular elongated flowpath 22 around the insert member and defined by the insert member 20 and the probe housing 11, to return to the condenser unit 12 via the outer annular lumen of the umbilical defined by the outer umbilical tube 15. The distal end portion 27 of the insert member has a cut-out configuration to allow passage of refrigerant even if the distal end of the insert member 20 butts against the distal end of the probe housing 19. The interaction of the insert member 20 and the probe housing 11 places the refrigerant in a flow path 22 just beneath and in fluid contact with the probe housing 11. This configuration gives improved heat transfer characteristics to the probe according to the present invention due to the increased time the refrigerant dwells within the probe 10, and at the same time the probe 10 according to the principles of the present invention is rugged due to the support the insert member 20 gives the probe housing 11 due to regular spacing of the turns of the channel defining the flow path 22, increasing the probes resistance to dents and the like.

As an alternative to a single spiral a double spiral may be used. This alternative shortens the length of the elongated fluid pathway 22 by half, but doubles its effective cross-sectional area, as the refrigerant must divide to follow each of the two spirals.

Figure 5:
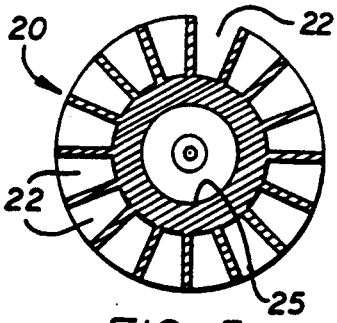
FIG. 5 is a sectional view, taken along line 5—5 in FIG. 4.

As alternatives to the spiral configuration of the elongated annular flowpath 22 defined by the insert member 20 and the probe housing 11, the insert member may be modified to provide other configurations of elongated flowpaths. For example, as illustrated in FIGS. 4 and 5 in another preferred embodiment a serpentine pathway around the circumference of the insert member may be provided wherein the fluid travels back and forth from the distal end to the proximal end, reversing directions and repeating this course as it slowly travels around the periphery of the cylindrical insert member and finally exits the pathway 22 at the proximal end of the insert member 20 at a location radially adjacent the place where the refrigerant entered the pathway 22 at the distal end of the insert member.

Figure 6:
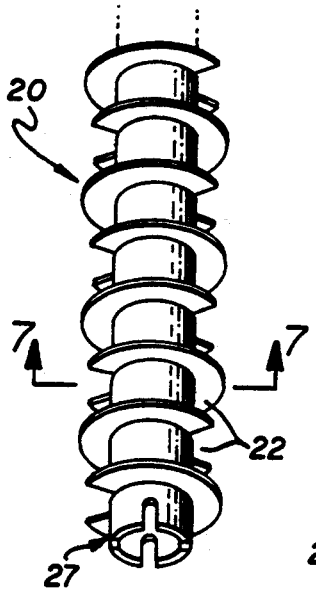
FIG. 6 is a perspective view of a second alternate embodiment of an insert member that may be placed within the probe.
Figure 7:
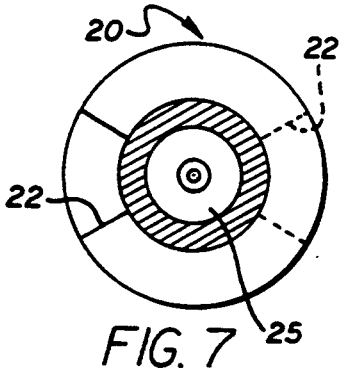
FIG. 7 is a sectional view, taken along line 7—7 in FIG. 6.

In another preferred embodiment illustrated by FIGS. 6 and 7, the annular elongated flowpath 22 is provided by forming parallel annular ring pathways in the outer periphery of the insert member 20 interconnected at radially opposite points. Thus, when the insert member is contained with in the probe housing 11 the refrigerant enters the first annular ring at the distal end portion 27 of the insert member, seeks the connection to the next annular ring at a first point, divides, and travels around both sides of the next annular ring, seeking the connection to the next annular ring located 180° from the connection at the first point, and continues, repeating this pattern as it makes its way to the proximal end of the insert member (and thereafter returns via the umbilical to the condenser 12). The connections between the annular rings are preferably of the same cross-sectional diameter as the flowpath 22, which in this case is doubled because the refrigerant divides and flows around both sides of each annular ring.

The insert member 20 may be made in any one of a number of well known ways. The choice of material from which it is made will dictate to a large extent the preferred manufacturing method. The insert member may be molded for example, or machined out of solid stock (or machined out of a molded piece which may have some features already incorporated therein). Should the probe be made very small it may be desirable to etch the elongated fluid pathway configuration into the insert member, for example by a photographic etching process.

Other configurations of insert member 20 and probe 10 may be employed other than the generally cylindrical probe described herein by way of example, witch nonetheless embody the invention. Flattened probes, squared off probes, and spherical probes for example might be constructed according to the present invention. The insert member employed in these alternately configured probes may be made by other processes, such as stamping for example.

The insert member of the exemplary embodiment described herein is made of aluminum, but the particular material chosen for the insert member is not particularly critical due to the configuration of the probe according to principles of the present invention. As the refrigerant is made to flow adjacent and in fluid contact with the probe housing 11, the thermal conductivity properties of the insert member are relatively less important unless intercooling of the refrigerant is desired as before described. However, some increase in efficiency can be obtained by using a material with good heat transfer properties. Aluminum was chosen because it does have good thermal conductivity properties, and it is easily machined. Therefore a good balance of cost of manufacture and efficiency is obtained.

However, plastics and other materials may be used. The insert member 20 is made slightly larger than the probe housing 11 and pressed into the housing so that a snug fit will obtain even when differential expansion and contraction due to thermal cycling is present. The thermal expansion and contraction of the materials employed may limit the combinations of materials employed for the probe housing 11 and the insert member 20, and preferably the coefficients of thermal expansion for the respective materials should be approximately the same. It has been found that when aluminum is used for the insert member and titanium for the probe housing an oversize of one thousandth for the insert member is sufficient to provide a snug fit and sealing of the annular elongated flowpath 22 when the insert member 20 is pressed into the probe housing 11 for working temperatures of the probe 10 of the exemplary embodiment using standard refrigerants such as R-12 and R-22.

Turning now to the probe housing 11 of the exemplary device embodiment, it is a tube of titanium, approximately one inch in diameter with a distal end 19 closed to provide a pressure tight containment. A proximal end the probe housing is necked down to a smaller diameter of approximately ⅜ inches and a proximal connector portion 14 is there provided about 1 inch in length. This proximal connector portion is formed by a conventional spinning process, as is the closure at the distal end 19. The outside diameter of the connector portion 14 is intended to be just larger than that of the inside of the outer coaxial umbilical tube 15 and the outer umbilical tube is fitted over the proximal connector portion and clamped pressure tight around it by means of at least one clamp 13. Clamp 13 is conventional and two such clamps preferably are used. The spinning process used to form the connector portion 14 makes the provision of annular ridges 34 therein very easy. Such ridges assist in sealing the flexible outer umbilical tube 15 to the probe housing 11 and preventing it from being separated from the probe housing.

Alternatively, the probe housing 11 could be made by a molding process or stamping process, or by some other conventional manufacturing method. Also alternatively, a probe housing could be molded or stamped around an insert member to provide a tight fit. The connection of the outer umbilical tube 15 to the housing 11 could also be made with the use of adhesives, heat bonding or other welding process, brazing, etc., depending upon the respective materials used for the umbilical and the probe housing, or by providing connection by some other connecting method such as threaded connector for example (not shown).

Figure 8:
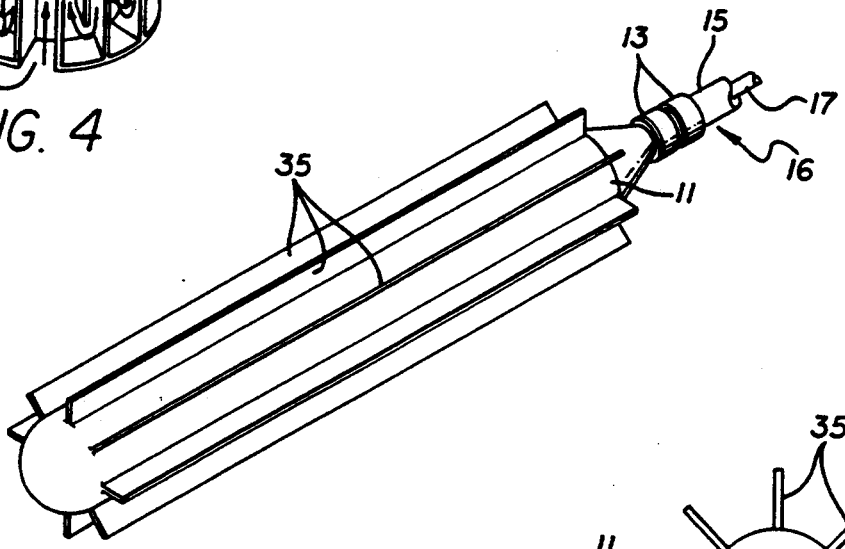
FIG. 8 is a perspective view of an alternate external configuration for a probe in accordance with principles of the present invention.
Figure 9:
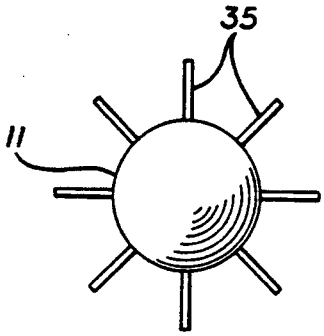
FIG. 9 is an end-on elevational view illustrating the external probe configuration illustrated in FIG. 8.

The probe housing 11 may be of the plain configuration illustrated by FIG. 1, or may have more complex external attributes. The plain titanium embodiment described is preferred for aquarium applications, due to ease of cleaning and other considerations singular to an aquarium environment. However, to improve heat transfer from the environment of the probe in other applications, radially outward directed fins 35 may be provided for example. This is illustrated in FIGS. 8 and 9.

Figure 10:
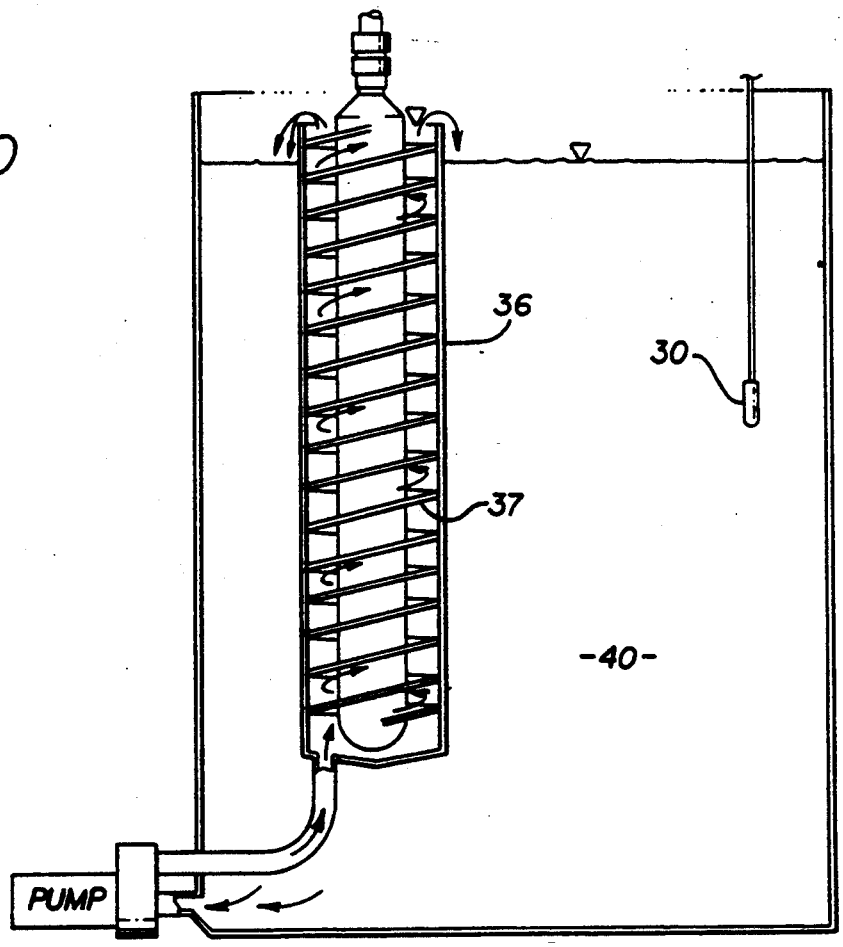
FIG. 10 is a schematic representation of an apparatus for enhanced cooling of a liquid environment using a probe in accordance with principles of the present invention.

It has been found that the heat transfer properties of a plain configured probe 10 as illustrated in FIG. 1 can also be enhanced by providing structure around the probe to direct fluid onto and around the probe. For example, the configuration shown schematically in FIG. 10 is provided to improve the efficiency of the probe. A fluid to be cooled is pumped from an environment 40 into a first end of a containment 36 having a spiral fin 37 on the interior thereof defining a central opening sized to slidably receive the probe 10. The containment, spiral fin, and probe thus assembled together define an elongated fluid path around the probe from the first end of the containment to a second open end. Fluid thus transits the interior of the containment along an elongated path from the first end to the second end allowing more heat to be transferred from the fluid to the probe. The fluid exits the containment at the second end and then returns to the environment 40. A temperature sensor 30 may also be employed to monitor the temperature of the fluid environment so that the temperature of the environment may be controlled, for example by adjusting the flow of refrigerant in the probe 10.

Figure 11:
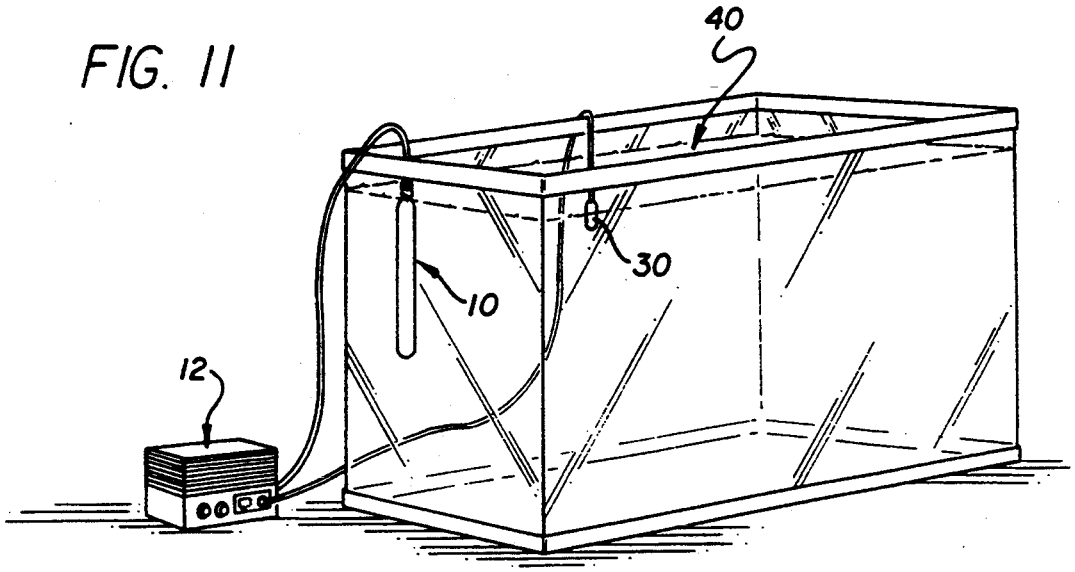
FIG. 11 is a perspective schematic representation of a refrigerative probe system in accordance with principles of the present invention used in an aquarium application.

The probe embodiment described herein cools of an aquarium as illustrated by FIG. 11. For example, as shown, the probe 10 is dipped into a water environment 40 of an aquarium tank which is to be cooled. A temperature sensor 30 associated with a conventional temperature control system as before described may be also placed in the fluid environment 40. Water is circulated past the probe and temperature sensor by natural convection or by currents in the fluid environment otherwise produced in the functioning of an aquarium (e.g. filtration or aeration). The temperature of the fluid environment is cooled to a desired temperature range by circulation of refrigerant through the probe (controlled by the temperature control system) to remove heat from the fluid environment as needed.

Referring now to FIG. 11 a refrigerative system employing the probe 10 herein described for use with an aquarium is shown dipped into a fluid environment 40 of an aquarium or the like is illustrated schematically. A temperature sensor 30 is also dipped into the aquarium environment, and a condenser unit 12 which may incorporate a temperature control system employing temperature sensor 30 is placed adjacent the aquarium tank. The condenser unit 12 may also be some distance away from the tank. As mentioned, it has been found using components of the dimensions given herein the umbilical may be up to about 15 feet in length.

In Aquarium applications titanium is the preferred material out of which to make the probe housing 11. This because of its inertness in salt water or other aquarium environments. Of course other materials may be used, and for other applications the probe housing 11 may be formed of materials particularly suited to the application. However, in all applications good thermal conductivity is desirable. If a material with relatively lower thermal conductivity is used, the probe housing should be made as thin as possible (given the other properties of the material and the application in which the probe is to be used) to maximize heat transfer.

Coatings may be applied to the exterior of the probe to suit particular applications, either to protect the probe housing 11 from the environment in which the probe 10 will be used, or to protect the environment from contamination by the materials from which the probe is constructed, or to provide padding. The same principles of maximizing as far as possible heat transfer (to maintain efficiency) apply to a coating as to the probe housing 11 itself discussed above and thermally conducted materials are preferable.

As can be seen from the forgoing description the probe 10 is simple in construction. The probe can be easily assembled in a straightforward manner. For example, the embodiment herein described is assembled by pressing an insert member 20 (configured as before described) into a probe housing 11 the distal end 19 of the probe housing having been previously spun closed, but the proximal connector portion 14 is yet to be formed, leaving the proximal end open. After the insert member 20 is pressed into place within the housing 11, the proximal connector portion 14 is formed by spinning. Next, connection of the tubes 15 and 17 of the umbilical 16 as previously described is made.

The distal end of the inner umbilical tube 17 is made to extend about 6" beyond the outer umbilical tube 15 as this will put the distal end of the inner umbilical tube at approximately the location of the step transition 24 of the central lumen 21 of the insert member 20 when the umbilical is attached. The inner umbilical tube 17 is straightened then slipped into the slip-fit portion 23 of the insert member and advanced until the outer umbilical tube 15 reaches the proximal connector portion 14 of the probe housing 11 and slips over it completely. The proximal connector portion 14 is preferably long enough that two clamps 13 can be applied to seal the connection. A protective coating can then be applied to the probe, clamps and umbilical if desired, but may be applied before connection of the umbilical or omitted.

A probe for use with standard refrigerants in a conventional refrigerative system, and specifically adapted to use with an aquarium or the like has been described in detail to this point. However, it will be apparent to one skilled in the art that the configuration of a probe according to principles of the present invention may also be advantageously used with other refrigerative systems, for example a cryogenic refrigerative system.

The advantages obtained by the probe 10 of the present invention apply as well to systems wherein a chilled liquid is pumped through the probe to absorb heat from the environment of the probe, which heat is separately removed from the chilled liquid by a separate refrigerative system. In such an arrangement however, there would of course be no need for structure comprising a Joule-Thomson valve to be provided in the probe 10.

From the foregoing, it will be appreciated that the remote refrigerative probe 10 of the present invention provides an improvement in efficiency by directing refrigerant in an elongated flowpath 22 just below and in fluid contact with the probe housing 11 by providing an insert member 20 within the probe housing 11 to interact with it to achieve this result. The probe thus constructed is easily assembled and rugged in use.

While a particular form of the invention has been described, it will be apparent that various modifications can be made without departing from the spirit and scope of the invention.

What is claimed is:

1. A remote refrigerative probe system adapted for cooling an environment in which the probe is placed by transfer of heat to a refrigerant flowing through the interior of said probe, comprising:

a thin walled housing defining an exterior surface of said probe, having an interior surface;

an insert member having proximal and distal ends, sealingly contained within said housing means, having an exterior surface portion adapted to conform to said interior surface of said housing, which has channels therein configured to define an elongated fluid flowpath adjacent and in fluid contact with said interior surface of said housing when said insert member is inserted into the housing to form said probe;

a refrigerant fluid conduit means for fluidly connecting said housing and insert member forming said probe to a source of liquid refrigerant and for carrying away gaseous refrigerant having absorbed heat from the environment of the probe.

2. The refrigerative probe system of claim 1, wherein said fluid conduit means for connecting said refrigerated probe to a source of refrigerant comprises a coaxial umbilical having an inner umbilical tube adapted to convey a refrigerant liquid to the probe, and an outer umbilical tube defining an annular outer umbilical lumen between the inner umbilical tube and the outer umbilical tube adapted to convey away refrigerant gas having absorbed heat from the environment of the probe.

3. The refrigerative probe system of claim 1, further comprising a lumen within said insert member interconnecting a proximal end and a distal end of said insert member.

4. The refrigerative probe system of claim 3, wherein the lumen within said insert member has a comparatively smaller diameter portion, and a distal portion of comparatively larger diameter.

5. The refrigerative probe system of claim 4, further comprising an orifice of relatively smaller diameter compared with the small diameter portion of the lumen of said insert, positioned between the smaller diameter portion of the lumen and the comparatively larger diameter portion of the lumen within said insert member.

6. The refrigerative probe system of claim 4, wherein said insert member is connected to a refrigerant supply at the comparatively smaller diameter portion of the lumen within said insert member.

7. The refrigerative probe system of claim 1, further comprising means for increasing contact between the exterior surface of said probe and a liquid environment, thereby enhancing heat transfer through said housing means.

8. A refrigerative probe system adapted for cooling an environment in which the probe is placed by transfer of heat to a refrigerant flowing through the interior of said probe and undergoing a phase change, comprising:

an outer housing member having first and second ends and an interior surface;

an insert member having first and second ends, and an exterior surface with an elongated groove formed therein, contained within said outer housing, said insert member sized such that the exterior surface fits tightly within, and in at least partial contact with, the interior surface of said outer housing member when the two are assembled to form a probe;

a conduit means for fluidly connecting said probe to a source of liquid refrigerant and for conveying away gaseous refrigerant having absorbed heat from the environment of the probe;

whereby an elongated fluid pathway is defined by, and in contact with said outer housing member and said insert member along which refrigerant is made to travel, and increased transfer of heat from the environment of the probe to the refrigerant flowing through the probe is realized.

9. The refrigerative probe system of claim 8, further comprising an orifice disposed in close proximity to said insert member.

10. The refrigerative probe of claim 8, further comprising a lumen through said insert member interconnecting the first and second ends of said insert member, said lumen being connected to a source of refrigerant at the first end by said conduit means, whereby refrigerant flows through the lumen to the second end of said insert member, then returns to the first end through the elongated fluid pathway.

11. The refrigerative probe system of claim 10, wherein said conduit means includes a refrigerant return lumen sealingly connected to said outer housing member at the first end, corresponding with the first end of said insert member, for conveying away refrigerant.

12. The refrigerative probe system of claim 11, wherein the conduit means comprises refrigerant supply and return lumens coaxially disposed, by concentrically disposed tubing, to form a single umbilical line, and the inner tubing extends into the insert member.

13. The refrigerative probe system of claim 12, wherein the umbilical line is connected to a remote condenser means for liquefying refrigerant.

14. The refrigerative probe system of claim 8, wherein said insert member is cylindrical in overall shape.

15. The refrigerative probe system of claim 14, wherein the elongated pathway is of spiral configuration.

16. The refrigerative probe system of claim 15, wherein elastic deformation of said insert member and said housing member cause said members to be tightly joined over the operating temperature range of said probe.

17. The refrigerative probe system of claim 16, wherein the insert member is formed of aluminum and the housing member is formed of titanium.

18. The refrigerative probe system of claim 17, further comprising a temperature controller operatively connected to said remote condenser means, and which further comprises a sensor located in the environment to be cooled by the probe system.

19. The refrigerative probe system of claim 18, wherein: said insert member is pressed into said housing, and the outer housing is closed at the first end by spinning said housing member down to a smaller diameter at the first end of said outer housing member to form a connector portion, and an inner tube of a coaxial umbilical is connected to said insert member through the small diameter connector portion of said outer housing member, and the outer tube of the coaxial umbilical is connected to the small diameter connector portion of said outer housing member.

20. A remote refrigerative probe system for use in cooling a liquid environment, comprising:

e. a probe, further comprising i. a cylindrical thin-walled probe housing having a closed distal end and a proximal connector portion and an interior surface, ii. a cylindrical insert member having a proximal end and a distal end, press fit into said cylindrical probe housing, having a central lumen and a spiral channel formed in the outer cylindrical surface thereof interconnecting the distal and proximal ends, said insert member cooperating with said probe housing to provide an elongated fluid flow-path in fluid contact with said interior surface of said probe housing;

f. a coaxial umbilical connected to said proximal end of said probe, having an inner umbilical tube for conveying a refrigerant liquid at a relatively high pressure, said inner umbilical tube being connected to said central lumen of said insert member at the proximal end, and an outer umbilical tube defining an annular outer umbilical lumen between said inner umbilical tube and said outer umbilical tube for conveying a refrigerant gas at a relatively low pressure, said outer umbilical tube being connected to said proximal connector portion of said probe housing thereby providing fluid communication between said annular outer umbilical lumen and the interior of said probe housing at the proximal end of said insert member sealed within said probe housing, for conveying away refrigerant gas which has been conveyed to said central lumen of said insert member by said inner umbilical tube in a liquid state and has expanded to a gaseous state and flowed back to said proximal end of said insert member along said elongated flow-path;

g. a condenser unit connected to said umbilical, which bifurcates said annular outer umbilical lumen conveying relatively low pressure refrigerant gas from said inner umbilical tube, and which condenses said refrigerant gas to a liquid state at a relatively high pressure and returns it to said probe within said inner umbilical tube;

h. a temperature control means including a mercury thermostat.

* * * * *

UNITED STATES PATENT AND TRADEMARK OFFICE

CERTIFICATE OF CORRECTION

PATENT NO. : 5,365,750

DATED : November 22, 1994

INVENTOR(S) : Greenthal, Steven

It is certified that error appears in the above-identified patent and that said Letters Patent is hereby corrected as shown below:

In the drawings, Sheet 1, Figures 1 and 2, the reference numeral 15a should be applied to the annular luminal space between outer tubular element 15 and inner tubular element 17

In the drawings, Sheet 1, Figures 1 and 2, reference numeral 17a should be applied to the luminal space within tubular element 17

Column 4, line 35, delete "manufacture" and insert therefor --manufacturer--

Column 4, line 42, following "power" insert thereafter --,--

Column 4, line 56, delete "0.65 inches (1.7 cm)" and insert therefor --0.065 inches (0.17 cm)--

Column 6, line 11, delete "patterns" and insert therefor --portions--

Column 9, line 24, following "cools" delete "of"

Column 10, line 4, delete "conducted" and insert therefor --conductive--

Column 12, line 65 (claim 20, line 3), delete "e." and insert therefor --a.--

UNITED STATES PATENT AND TRADEMARK OFFICE

CERTIFICATE OF CORRECTION

PATENT NO. : 5,365,750

DATED : November 22, 1994

INVENTOR(S) : Greenthal, Steven

It is certified that error appears in the above-identified patent and that said Letters Patent is hereby corrected as shown below:

Column 13, line 10 (claim 20, line 16), delete "f." and insert therefor --b.--

Column 14, line 11 (claim 20, line 37), delete "g." and insert therefor --c.--

Column 14, line 18 (claim 20, line 44), delete "h." and insert therefor --d.--

Signed and Sealed this

Twenty-second Day of August, 1995

Bruce Lehman

*Attest:*

BRUCE LEHMAN

*Attesting Officer*

*Commissioner of Patents and Trademarks*